US007311153B2

(12) United States Patent
McKee et al.

(10) Patent No.: US 7,311,153 B2
(45) Date of Patent: Dec. 25, 2007

(54) FLOW-BIASED SEQUENCING VALVE

(75) Inventors: L. Michael McKee, Friendswood, TX (US); Avel Ortiz, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 196 days.

(21) Appl. No.: 11/152,480

(22) Filed: Jun. 14, 2005

(65) Prior Publication Data

US 2005/0279506 A1 Dec. 22, 2005

Related U.S. Application Data

(60) Provisional application No. 60/580,751, filed on Jun. 18, 2004.

(51) Int. Cl.
*E21B 34/10* (2006.01)
*E21B 37/00* (2006.01)

(52) U.S. Cl. ..... 166/374; 166/312; 166/386; 166/319

(58) Field of Classification Search ..... 166/312, 166/374, 222, 334.4, 319, 386
See application file for complete search history.

(56) References Cited

U.S. PATENT DOCUMENTS 4,162,691 A * 7/1979 Perkins ..... 137/613
4,293,037 A * 10/1981 Calderon ..... 166/312
4,749,044 A * 6/1988 Skipper et al. ..... 166/323
4,793,417 A * 12/1988 Rumbaugh ..... 166/312
4,936,334 A 6/1990 Hendershot
4,951,750 A * 8/1990 Wetzel, Jr. ..... 166/278
5,195,585 A * 3/1993 Clemens et al. ..... 166/222
5,409,061 A * 4/1995 Bullick ..... 166/278
6,039,117 A * 3/2000 Mueller ..... 166/312
6,065,541 A * 5/2000 Allen ..... 166/318
6,286,614 B1 * 9/2001 Gano et al. ..... 175/274
6,293,341 B1 9/2001 Lemetayer ..... 166/250.15
6,536,529 B1 3/2003 Kerr et al. ..... 166/375
6,679,472 B2 1/2004 Baugh ..... 251/62
6,681,852 B2 * 1/2004 Baskett et al. ..... 166/208
6,695,066 B2 * 2/2004 Allamon et al. ..... 166/386
2001/0018976 A1 * 9/2001 Carmichael et al. ..... 166/312
2003/0094285 A1 * 5/2003 French ..... 166/380
2004/0168828 A1 9/2004 Mock et al. ..... 175/51
2004/0216883 A1 * 11/2004 Allen ..... 166/312
2005/0109516 A1 5/2005 Wilson et al. ..... 166/369
2005/0217856 A1 * 10/2005 Chen et al. ..... 166/312

* cited by examiner

*Primary Examiner*—Jennifer H. Gay
*Assistant Examiner*—Shane Bomar
(74) *Attorney, Agent, or Firm*—Rodney Warfford; David Cate; Jaime Cestano

(57) ABSTRACT

A technique that is usable with a well includes providing a sequencing valve to in a first state to communicate a first flow through a first port of the valve and in a second state close fluid communication through the first port. The technique includes communicating a second flow through an orifice of the sequencing valve during the second state of the valve and using a pressure drop across the orifice to bias the sequencing valve to remain in the second state.

23 Claims, 4 Drawing Sheets

FLOW-BIASED SEQUENCING VALVE

This application claims the benefit, pursuant to 35 U.S.C. § 119(e), to U.S. Provisional Application Ser. No. 60/580,751, entitled, "Methods And Apparatus For Use In Downhole Operations," filed on Jun. 18, 2004.

BACKGROUND

The present invention relates to methods and apparatus useful in operations in a downhole environment, and in particular useful for operations in multi-lateral wellbores having a main wellbore from which multiple bores (laterals) extend or radiate.

Operations in multi-lateral wells are commonly run on coiled tubing and use a Multi Lateral Tool (MLT) to find the desired lateral leg of the well. Common operations for example include washing, cleaning out the wellbore, scale removal and stimulation. When a wellbore operation is required in a multi-lateral well, two separate operations must be performed. First, the desired bore must be found and entered using a MLT. The MLT operates at a high flow rate and a low pressure. As fluid is pumped through the MLT, the tool is manipulated in the well bore. When the end of the tool encounters a lateral, the fluid flow changes, and the associated change in flow pressure is detected at the surface. In response to this detection, the tool is then conveyed into the lateral for the desired operation. Then to perform many desired operations, such as cleanout, stimulation, or scale removal in the targeted lateral, a higher pressure is often required. However, the higher pressure required for the desired operation in the tool is often too great of a pressure at which to operate the pumping system. Therefore a shift in system flow rate and pressure is required between the steps of operating the MLT and performing the desired operation using the tool.

SUMMARY

In an embodiment of the invention, a technique that is usable with a well includes providing a sequencing valve to in a first state, allow communication of a first flow through a first port of the valve and in a second state, close fluid communication through the first port. The technique includes communicating a second flow through an orifice of the sequencing valve during the second state of the valve and using a pressure drop across the orifice to bias the sequencing valve to remain in the second state.

In another embodiment of the invention, a sequencing valve includes a body, a movable member and an orifice. The body includes a first port to communicate a first fluid flow in a first state of the valve. The movable member is located in the body and has a fluid passageway. The moveable member closes fluid communication through the first port during a second state of the valve. The orifice is attached to the moveable member to restrict a second flow through the fluid passageway of the member in the second state of the valve to create a pressure drop across the orifice to bias the moveable member to close the first port.

Advantages and other features of the invention will become apparent from the following description, drawing and claims.

DETAILED DESCRIPTION

Figure 1:
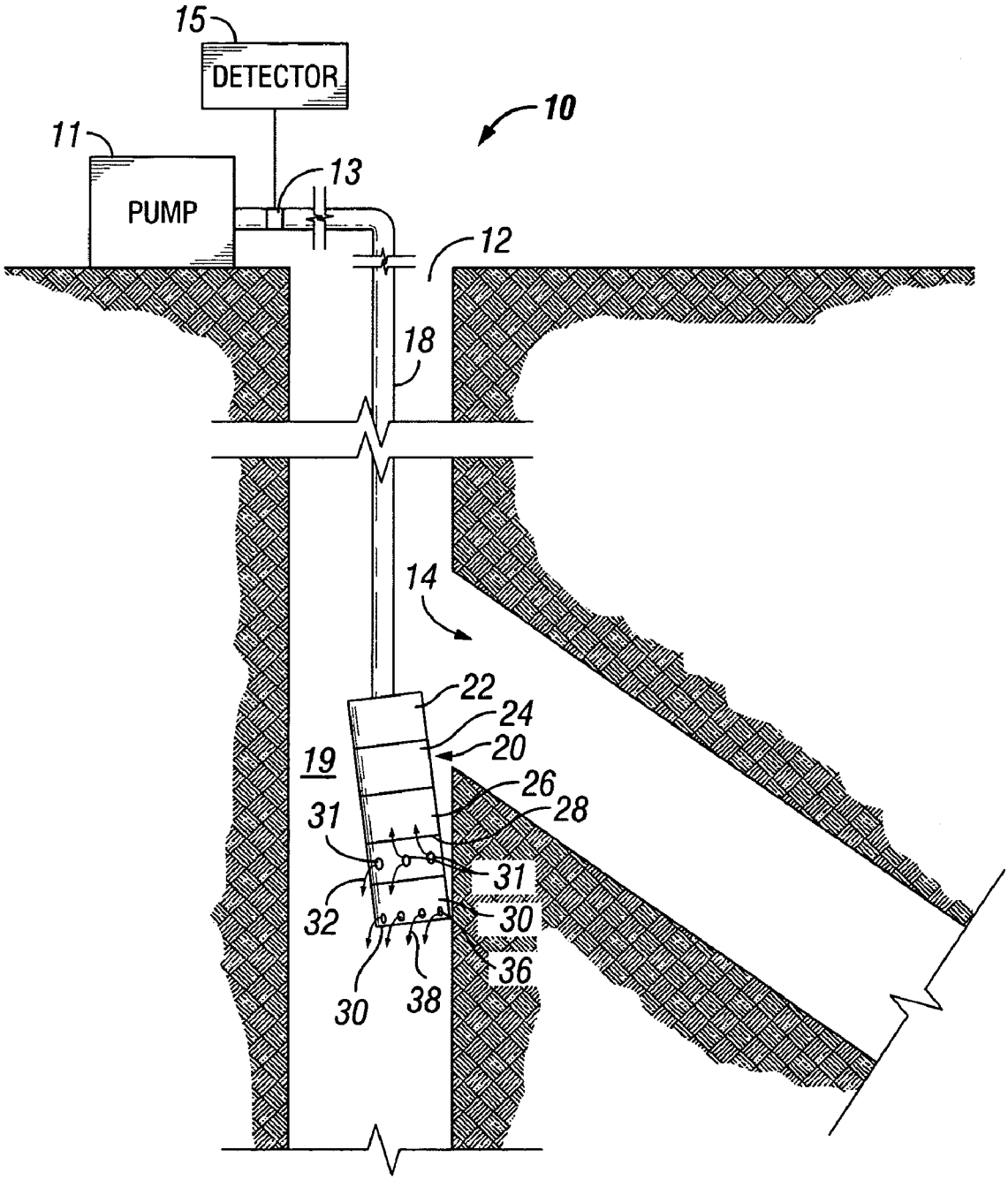
FIG. 1 depicts a work string in a lateral wellbore detection operation according to an embodiment of the invention.

Referring to FIG. 1, in accordance with an embodiment of the invention, a work string 18 is used for purposes of locating lateral wellbores (such as an exemplary lateral wellbore 14) of a multilateral well 10 and performing an operation, such as an operation that involves cleaning, stimulating or removing scale deposits (as examples), in each located lateral wellbore. More specifically, in accordance with some embodiments of the invention, the work string 18 includes a tool assembly 20 that, among its other features, includes a shuttle, or sequencing, valve 28 that generally has two states: an open state (depicted in FIG. 1) in which the sequencing valve 28 allows fluid communication through radial circulation ports 31 (to configure the work string 18 to be used to locate a lateral wellbore, for example); and a closed state (depicted in FIG. 2) in which the sequencing valve closes fluid communication through the radial circulation ports 31 (to configure the work string to be used to perform an operation in the lateral wellbore, for example). Although fluid communication through the radial circulation ports are blocked off during the closed state of the sequencing valve 28, the valve 28 directs a fluid flow through a central passageway of the valve 28 to a lower work tool 30.

As further described below, the sequencing valve 28 is constructed to rely on a fluid flow that is present in the closed state of the valve 28 to bias the valve 28 to remain in the closed state. Due to this bias, when the flow that flows through the central passageway of the sequencing valve 28 during its closed state decreases below a certain threshold flow (a fluid flow that is less than one half of the fluid flow used to close the valve 28, as an example), the valve 28 transitions back to the open state. Thus, the re-opening of the sequencing valve 28 is not affected by underbalanced well conditions.

In accordance with some embodiments of the invention, in its open state, the sequencing valve 28 is configured to communicate fluid to the annulus that surrounds the tool assembly 20 at a relatively low pressure and a relatively high flow rate. More particularly, as depicted in FIG. 1, in the open state of the sequencing valve 28, a fluid flow 32 exits the radial circulation ports 31 into the annulus 19 of the well. When the sequencing valve 28 is in the open state, the work string 18 may be used to, for example, communicate fluid from the surface to the annulus in an operation (herein called a "wellbore detection operation") to locate a lateral wellbore. This operation may, for example, use a flow rate of approximately 1.5 barrels per minute (BPM), although other flow rates may be used in other embodiments of the invention.

During the wellbore location operation, when a target or expected flow rate is encountered, a lateral wellbore detection tool 26 of the work string 18 generates a pressure signal that is sensed at the surface (via a detector 15 that is coupled to a pressure sensor 13 at the surface, for example) to indicate a lateral wellbore has been located. At this point, the flow to the sequencing valve 28 is increased (to a flow rate of approximately 1.8 BPM, as an example) to transition the valve 28 to its closed state to reconfigure the tool assembly 20 to use the work tool 30.

More particularly, when the sequencing valve 28 is in the closed state, the fluid from the work string 18 flows in its entirety (due to the closing of the radial circulation ports 31) to nozzles 36 of the work tool 30 so that an operation may be performed in the lateral wellbore. As examples, the work tool 30 may be used in an operation to clean, stimulate or remove scale from the lateral wellbore when the sequencing valve 28 is in its closed state.

As depicted in FIG. 1, in accordance with some embodiments of the invention, the nozzles 36 communicate a flow 38 into the well during both the open and closed states of the sequencing valve 28. However, due to the relatively low pressure of the flow when the sequencing valve 28 is in its open state (i.e., when the radial circulation ports 31 are open), very little flow (as compared to the overall flow through the valve 28) exits the nozzles 36. This is to be compared to closed state of the valve 28 in which all of the flow through the valve 28 exits the nozzles 36.

In addition to the work tool 30 and the lateral wellbore detection tool 26, the tool assembly 20 may include, for example, a motor head assembly 24 that receives fluid (via the central passageway of the work string 18) that is pumped downhole via a surface pump 11 (as an example). The motor head assembly 24 may be controlled from the surface of the well for purposes of controlling the rate and pressure of the fluid that is communicated downstream from the assembly 24 to the sequencing valve 28. The tool assembly 20 may also include a connector 22 for purposes of connecting the tool assembly 20 to the portion of the work string 18 above the assembly 20. In accordance with some embodiments of the invention, the work string 18 may be formed from coiled tubing, although other types of conveyance mechanisms (such as jointed tubing, for example) for the tool assembly 20 may be used, in other embodiments of the invention.

Figure 2:
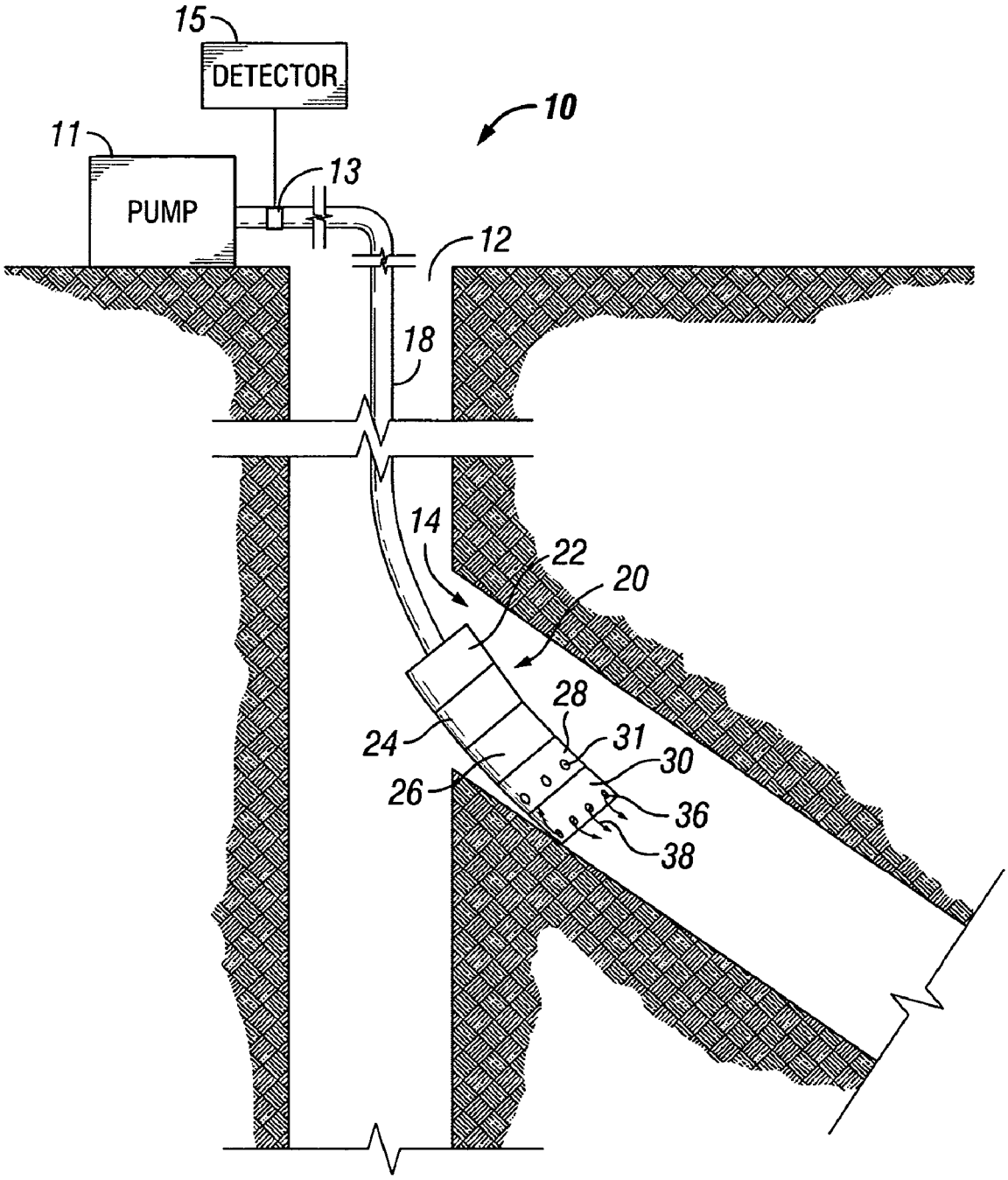
FIG. 2 depicts the work string in a subsequent operation in a located lateral wellbore according to an embodiment of the invention.

FIG. 2 depicts the tool assembly 20 when the sequencing valve 28 is in its open state and upon location of the exemplary lateral wellbore 14. As shown in FIG. 2, when the tool assembly 20 lands inside the entrance portion of the lateral wellbore 14, the tool assembly 20 bends. This bending, in turn, may be detected by a bending sub of the lateral wellbore detection tool 26. In response to this bending, the lateral wellbore detection tool 26 communicates a pressure signal to the surface of the well that may be detected for purposes of indicating to an operator at the surface that the lateral wellbore 14 has been located. At this point, the operator at the surface of the well may then transition the sequencing valve 28 into its closed state by increasing the flow rate of the fluid flow to the sequencing valve 28 above a predetermined threshold. The sequencing valve 28 responds to the increased flow rate (as further described below) to close the radial circulation ports 31 and transition to the closed state. In this state, all flow through the sequencing valve 38 is routed through the nozzles 36 in accordance with the lateral wellbore operation to be performed inside the lateral wellbore 14.

Although embodiments of the invention are described herein in which the tool string 20 transitions between a relatively high flow rate, low pressure operation and a relatively low flow rate, lower pressure operation, the embodiments that are described herein are applicable in general to all types of operations that may be performed with a lateral wellbore detecting tool.

Figure 3:
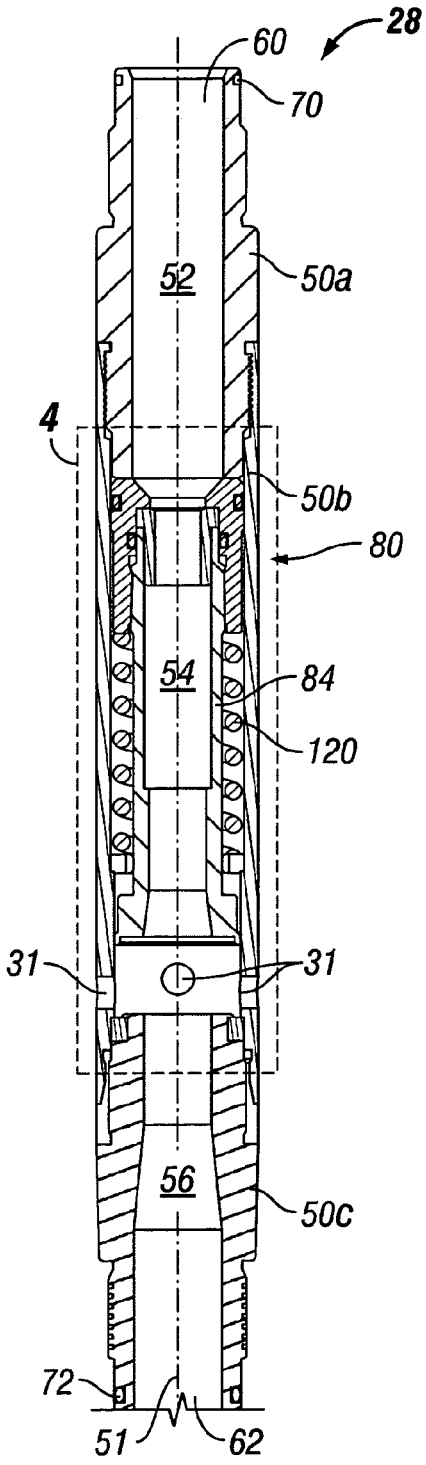
FIG. 3 is a cross-sectional view of a sequencing valve of the work string according to an embodiment of the invention.

Referring now to a more specific example of a possible embodiment of the sequencing valve 28, FIG. 3 depicts an embodiment of the valve 28 in its open state, i.e., the state in which fluid communication may occur through the radial circulation ports 31. In accordance with some embodiments of the invention, the sequencing valve 28 includes a housing that is formed from an upper tubular housing section 50*a*, a middle tubular housing section 50*b* and a lower tubular housing section 50*c*. The housing sections 50*a*, 50*b* and 50*c* are concentric with each other, share a common longitudinal axis 51 and include central passageways 52, 54 and 56, respectively, in some embodiments of the invention. Regardless of the state of the sequencing valve 28, the central passageways 52, 54 and 56 are always in communication in that the sequencing valve 28 always permits fluid communication between its top opening 60 (leading to the central passageway 52 and in communication with the central passageway of the string 18 above the sequencing valve 28) and its bottom opening 62 (exiting the central passageway 56 and in communication with the wash tool 32). As depicted in FIG. 3, in some embodiments of the invention, the radial ports 31 may be formed in the sidewall of the middle housing section 50*b*.

Figure 4:
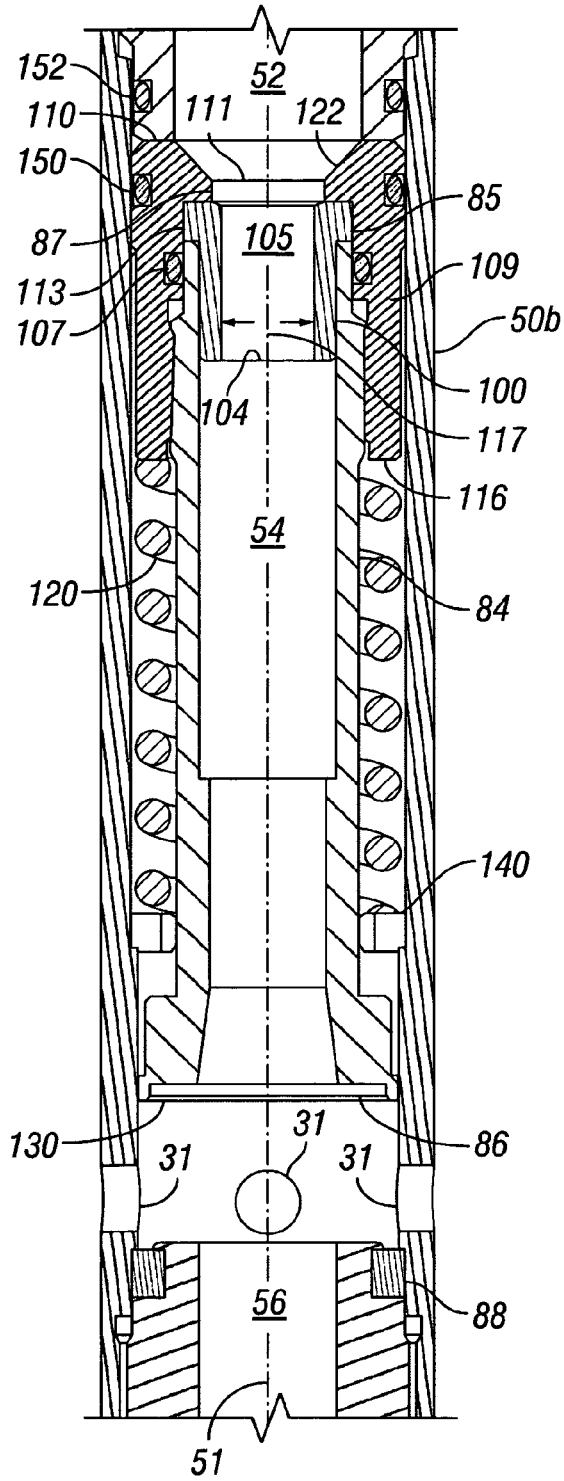
FIG. 4 is an expanded view of a selected section of the sequencing valve taken from FIG. 3 according to an embodiment of the invention.

FIG. 4 depicts a detailed section 80 (see FIG. 3) of the sequencing valve 28 to illustrate certain features of the valve 80, which regulate the communication of fluid through the radial circulation ports 31. Referring to FIG. 4, in accordance with some embodiments of the invention, the sequencing valve 28 includes a moveable member, a piston 109, which is generally concentric with the longitudinal axis 51 of the valve 28. The piston 109 includes an inner passageway 111 and has an upper surface 122 that presents an area (herein called the "A1 area") on which certain forces may act on the piston 109, as further described below. The inner passageway 111 of the piston 109 receives an upper end of a tubular valve seat 84 and a control orifice sleeve 100. The piston 109 is attached to the upper end of the tubular valve seat 84 and is concentric with the valve seat 84. The valve seat 84 forms part of the passageway 54, and the lower end 86 of the valve seat 84 has a lower surface 130 that presents an area (herein called the "A3 area") on which certain forces act on the valve seat 84, as further described below. A lower end 86 of the valve seat 84 is constructed to form a seal with a sealing element 88 of the sequencing valve 28 when the valve seat 84 is in its lowest position (a position not depicted in FIG. 4) and presses against the element 88.

In the lowest position of the valve seat 84, the sequencing valve 28 is in its closed state so that the tubular sidewall of the valve seat 84 blocks fluid communication through the radial circulation ports 31. Therefore, in the closed state of the sequencing valve 28, fluid is communicated through the valve 28 only through the central passageways 52, 54 and 56 (and to the work tool 32 (see FIG. 2, for example), as no fluid exits the radial circulation ports 31.

The sequencing valve 28 is biased to remain in the closed state by the flow that passes through the valve 28 in this state due to the presence of the control orifice sleeve 100. More specifically, in some embodiments of the invention, the control orifice sleeve 100 is concentric with the longitudinal axis 51 and has a radially-outwardly extending shoulder 113 that is located between the top end of the valve seat 84 and a radially-inwardly extending shoulder of the piston 109 to secure the control orifice sleeve 100 to the piston 109 and the valve seat 84. The control orifice sleeve 100 creates a flow restriction that introduces a pressure differential, or drop, which biases the sequencing valve 28 to remain in its closed state. The control orifice sleeve 100 has a central passageway 105 that is generally aligned with the longitudinal axis 51 of the sequencing valve 28 and presents a cross-sectional flow area 117 (herein called the "A2 area").

In accordance with some embodiments of the invention, during the open state of the sequencing valve 28, all of the flow passes through the central passageway 105 of the control orifice sleeve 109 and creates a pressure differential across the piston 109. This pressure differential is proportional to the A1 area less the A2 area and produces a downward force on the piston 109 and the attached valve seat 84. This downward force, however, is countered by an upward force that is exerted by a coil spring 120 (of the sequencing valve 28), which is compressed by downward displacement of the piston 109.

At a predetermined flow rate, such as 1.8 barrels per minute (BPM) (as an example), the pressure differential across the control orifice sleeve 100 becomes sufficient to compress the coil spring 120 enough to allow the valve seat 84 to seal against the sealing element 88 to close off the radial ports 31 and transition the sequencing valve 28 from the open to the closed state.

In the closed state of the sequencing valve 28, the pressure differential across the control orifice sleeve 100 acts on the effective piston area, which is the A3 area less the A2 area. An additional force acts on the piston 109 equal to the pressure difference between the inside of the sequencing valve 28 and the annular area that surrounds the sequencing valve. This pressure difference acts on the A1 area less the A3 area. In this configuration, the primary force that keeps the sequencing valve 28 in the closed state is the pressure drop across the control orifice sleeve 100. The proportion of the force that acts downwardly on the piston 109 created by the flow through the orifice sleeve 100 and a force that is created by the inside-to-outside pressure differential may be changed by increasing or decreasing the A3 area relative to the A1 area and the A2 area. Adjusting the area ratio allows the sequencing valve 28 to be designed to open at any portion of closing pressure in the range of, for example, 0.1 to 1.2 times the closing pressure, in accordance with some embodiments of the invention.

When the sequencing valve 28 transitions to the closed state, the flow through the radial circulation ports 31 is shut off, diverting all of the flow to the work tool 30 (see FIG. 2, for example). Since more flow is exiting the nozzles 36 of the tool 30 and not through the radial circulation ports 31, the pressure inside the string 18 rises. This pressure increase is detectable at the surface, and in response to detection of the pressure increase, the flow rate may be decreased to approximately one BPM (as an example) to limit the surface pressure. This flow rate may then be maintained while the operation is performed in the lateral wellbore.

In accordance with some embodiments of the invention, after the wellbore processing operation is completed, the flow rate may be decreased to approximately 0.75 BPM. The pressure drop across the control orifice sleeve 100 decreases accordingly; and as a result of this pressure drop, the valve seat 84 moves in a upward direction, and the sequencing valve 28 open transitions back to the open state. At this point, the string 18 may be moved to the next lateral wellbore and then the above-described process may be repeated.

It is noted that the sequencing valve 28 may have a number of sealing elements, such as o-rings, to form fluid barriers between different the parts of the sequencing valve 28. For example, in some embodiments of the invention, the sequencing valve 28 includes an o-ring 152 that is located in an annular slot that is formed in the outer surface of the lower end of the upper housing section 50*a* for purposes of forming a seal between the upper housing section 50*a* and the middle housing section 50*b*. Similarly, a seal may be formed between the middle housing section 50*b* and the lower housing section 50*c*, in some embodiments of the invention. Additionally, in accordance with some embodiments of the invention, the outer surface of the piston 109 includes in an annular slot that houses an o-ring 150 that forms a seal between the outer surface of the piston 109 and the inner surface of the middle housing section 50*b*. Additionally, in accordance with some embodiments of the invention, an annular slot is formed in the inner of the piston 109 for purposes of receiving an o-ring 107 to form a seal between the inner surface of the piston 109 and the outer surface of the valve seat 84.

Figure 5:
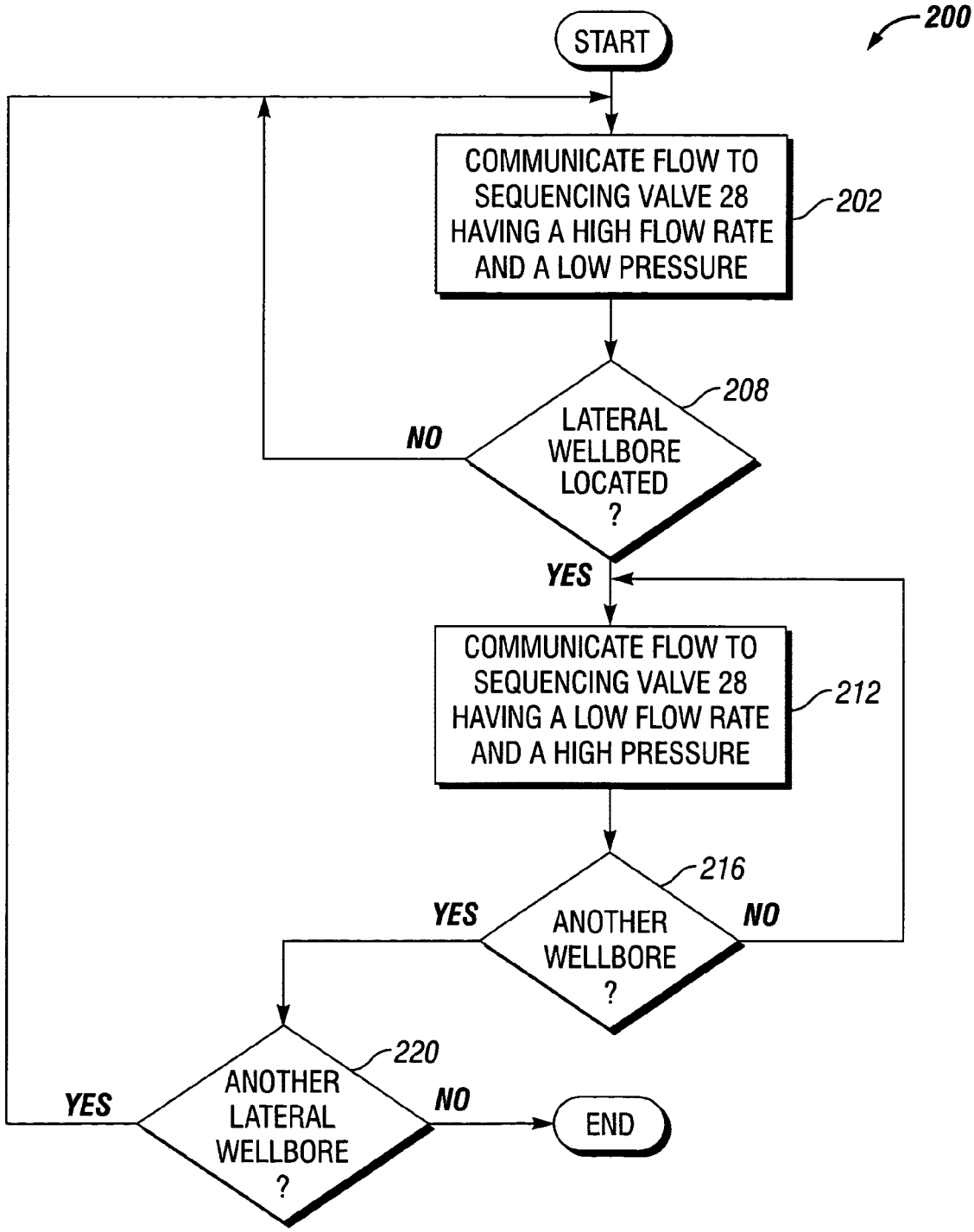
FIG. 5 is a flow diagram depicting a technique to locate and perform operations in lateral wellbores of a multilateral well according to an embodiment of the invention.

To summarize, referring to FIG. 5, a technique 200 may be used in accordance with embodiments of the invention for purposes of locating lateral wellbores and performing operations in the located wellbores. Pursuant to the technique 200, a flow is communicated to the sequencing valve 28, which has a relatively high flow rate and a low pressure, as depicted in block 202. Based on the resultant pressure signal that is detected at the surface of the well in response to the bending of the sub of the lateral wellbore detection tool 26 (see FIG. 1), the next lateral wellbore may be located. If a determination (diamond 208) is made that a lateral wellbore has been located, then control transitions to block 212 in which a flow is communicated to the sequencing valve 28, which has a relatively low flow rate and a high pressure to close the sequencing valve. As pointed out above, in connection with block 212, the pressure inside the string 18 may rise upon closing of the sequencing valve 28, and in response to the pressure increase that is detected at the surface of the well, the flow rate may be decreased to limit surface pressure. When the operation is complete, the flow rate is reduced to the appropriate level to remove the pressure bias that is introduced by the control orifice sleeve 100 to cause the sequencing valve 28 to transition to its open state.

If it is determined (diamond 216) that the wellbore operation is complete, then a decision is made (diamond 220) whether another wellbore is to be processed. If so, control transitions to block 202.

While the use of terms of orientation and direction, such as "up," "vertical," "lower," etc. have been used herein for purposes of simplicity to describe certain embodiments of the invention, it is understood that other directions and orientations are within the scope of the appended claims. For example, in other embodiments of the invention, the piston of the sequencing valve may move in an upward direction for purposes of closing off radial circulation ports. Thus, many variations are possible and are within the scope of the appended claims.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method usable with a well, comprising:

providing a sequencing valve to in a first state communicate a first fluid flow through a first port of the valve and in a second state close fluid communication through the first port;

communicating a second flow through an orifice of the sequencing valve during the second state of the valve and using a pressure drop across the orifice to bias the sequencing valve to remain in the second state;

wherein the valve in the first state is used in connection with a first operation that is associated with a higher flow rate and lower pressure, and the valve in the second state is used with a second operation that has a relatively lower flow rate and higher pressure; and wherein the first operation comprises an operation to locate a lateral wellbore, and the second operation comprises an operation to wash the lateral wellbore.

2. The method of claim 1, further comprising:

opening the first port in response to the second flow decreasing below a predetermined flow rate.

3. The method of claim 1, the method further comprising:

lowering the sequencing valve downhole in the well on a tubular member; and forming a fluid column in the tubular member that exerts a pressure on the sequencing valve to place the sequencing valve in the second state, wherein the well comprises an underbalanced well and the pressure is insufficient to maintain the first port closed in the absence of the pressure drop.

4. The method of claim 1, further comprising:

providing a spring to bias the sequencing valve to transition to the first state to open the first port; and closing the first port in response to the pressure drop decreasing below a pressure threshold.

5. The method of claim 1, further comprising:

communicating the second flow through a second port of the valve during the second state.

6. The method of claim 5, further comprising:

communicating a partial fluid flow through the second port during the first state.

7. The method of claim 1, wherein the first port comprises one of a set of radial ports of the valve.

8. A sequencing valve comprising:

a body comprising a first port to communicate a first fluid flow in a first state of the valve;

a moveable member located in the body and having a fluid passageway, the moveable member to close fluid communication through the first port during a second state of the valve;

an orifice attached to the moveable member to restrict a second flow through the fluid passageway during the second state to create a pressure drop across the orifice to bias the moveable member to close fluid communication through the first port, wherein the movable member comprises opposing surface areas acted on by a closing pressure and an opening pressure, respectively, such that the ratio of the opposing surface areas is selected so the movable member is returned from the second state to the first state when the opening pressure is at a desired ratio with respect to the closing pressure;

wherein the valve in the first state is used in connection with a first operation that is associated with a higher flow rate and lower pressure, and the valve in the second state is used with a second operation that has a relatively lower flow rate and higher pressure; and wherein the first operation comprises an operation to locate a lateral wellbore, and the second operation comprises an operation to wash the lateral wellbore.

9. The sequencing valve of claim 8, wherein the moveable member forms a valve seat to contact a seal to close the first port during the second state.

10. The sequencing valve of claim 8, further comprising a spring attached to the body and being compressible in response to the pressure drop to close the first port.

11. The sequencing valve of claim 10, wherein the spring exerts a force on the moveable member to open the first port in response to the pressure drop decreasing below a pressure threshold.

12. The sequencing valve of claim 8, wherein the fluid passageway is in communication with a fluid column present in a string connected to the valve, the fluid column exerts a pressure on the moveable member to close the first port during the second operation, the well comprises an underbalanced well, and the pressure is insufficient to maintain the first port closed in the absence of the pressure drop.

13. The sequencing valve of claim 8, further comprising:

communicating the second flow through a second port of the valve during the second operation.

14. The sequencing valve of claim 8, wherein the first port comprises one of a set of radial ports.

15. A system usable with a well, comprising:

a tool; and a sequencing valve coupled between the tool and a fluid source, the sequencing valve adapted to:

in a first state of the valve, allow fluid communication between the fluid source and the tool and through a first port of the valve, and during a second state of the valve, close fluid communication between the first port and the fluid source and allow fluid communication between the fluid source and the tool, wherein the sequencing valve comprises an orifice to communicate fluid from the fluid source and establish a pressure differential across the orifice to bias the sequencing valve in the second state to close the communication between the fluid source and the first port; and another tool to detect a lateral well bore during the first operation.

16. The system of claim 15, further comprising:

a connector to connect the sequencing valve and the tool to a conveyance string.

17. The system of claim 16, wherein the fluid source includes a motor located between the connector and the sequencing valve.

18. The system of claim 15, wherein the first port comprises one of a set of radial ports.

19. The system of claim 15, wherein the tool comprises at least one of a wash tool, a scale removal tool and a stimulation tool used during the second state.

20. The system of claim 15, wherein the sequencing valve is adapted to open the first port in response to a rate of the second flow decreasing below a predetermined threshold.

21. The system of claim 15, wherein the valve in the first state is used in connection with a higher flow rate and lower pressure first operation, and the valve in the second state is used with a lower flow rate and higher pressure second operation, the first operation being associated with a higher flow rate than the second operation.

22. The system of claim 21, wherein the first operation comprises an operation to locate a lateral wellbore, and second operation comprises an operation to wash the lateral wellbore.

23. The system of claim 15, wherein the sequencing valve comprises a spring to bias the sequencing valve to transition the valve to the first state to open the first port, and the spring is adapted to close the first port in response to the pressure drop exceeding a threshold.

* * * * *